US009389542B2

(12) United States Patent
Nakano et al.

(10) Patent No.: US 9,389,542 B2
(45) Date of Patent: Jul. 12, 2016

(54) UNIT ASSEMBLY AND IMAGE FORMING APPARATUS

(71) Applicant: Sharp Kabushiki Kaisha, Osaka-shi, Osaka (JP)

(72) Inventors: Kuniaki Nakano, Osaka (JP); Naoaki Kurimoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/440,651

(22) PCT Filed: Nov. 13, 2013

(86) PCT No.: PCT/JP2013/080625

§ 371 (c)(1),
(2) Date: May 5, 2015

(87) PCT Pub. No.: WO2014/080809

PCT Pub. Date: May 30, 2014

(65) Prior Publication Data

US 2015/0253695 A1 Sep. 10, 2015

(30) Foreign Application Priority Data

Nov. 26, 2012 (JP) ..... 2012-257384
Oct. 15, 2013 (JP) ..... 2013-214578

(51) Int. Cl.
*G03G 21/16* (2006.01)
*G03G 21/18* (2006.01)
*G03G 15/16* (2006.01)

(52) U.S. Cl.
CPC ..... *G03G 15/1605* (2013.01); *G03G 21/168* (2013.01); *G03G 21/1619* (2013.01); *G03G 21/1647* (2013.01); *G03G 21/1842* (2013.01); *G03G 2215/0132* (2013.01)

(58) Field of Classification Search
CPC ..... G03G 21/1619; G03G 21/1647; G03G 21/168; G03G 21/1842
See application file for complete search history.

(56) References Cited

U.S. PATENT DOCUMENTS

2002/0031369 A1* 3/2002 Tokutake ..... G03G 21/1647 399/110
2007/0059033 A1 3/2007 Kitozaki
(Continued)

FOREIGN PATENT DOCUMENTS

JP 09-304994 A 11/1997
JP 2003-255760 A 9/2003
(Continued)

OTHER PUBLICATIONS

Official ommunication issued in International Patent Application No. PCT/JP2013/080625, mailed on Feb. 18, 2014.

*Primary Examiner* — Rodney Bonnette
(74) *Attorney, Agent, or Firm* — Keating & Bennett, LLP

(57) ABSTRACT

A unit assembly (10) includes an image forming unit (20) and an intermediate transfer unit (40), and is configured insertably/removably with respect to an apparatus main body. The image forming unit (20) includes a plurality of process units (200A to 200D) and a joint member (80) that joints the plurality of process units (200A to 200D). The intermediate transfer unit (40) is held by the image forming unit (20). The intermediate transfer unit (40) and the joint member (80) have a first positioning section (611, 612) for mutually relative positioning.

8 Claims, 12 Drawing Sheets

(56) References Cited

U.S. PATENT DOCUMENTS

2010/0209140 A1* 8/2010 Kamimura ..... G03G 15/01 399/111
2015/0205249 A1* 7/2015 Kurimoto ..... G03G 15/0189 399/113

FOREIGN PATENT DOCUMENTS

JP 2007-072330 A 3/2007
JP 2007-086384 A 4/2007

* cited by examiner

UNIT ASSEMBLY AND IMAGE FORMING APPARATUS

TECHNICAL FIELD

The present invention relates to a unit assembly to be mounted on a tandem-type image forming apparatus that operates based on the intermediate transferring scheme of transferring an image of developer onto a sheet via an intermediate transfer unit, and relates to an image forming apparatus including the same.

BACKGROUND ART

A tandem-type image forming apparatus based on the intermediate transferring scheme includes: processing units such as a process unit including a photoreceptor drum, a developing unit including a developer bearing member, and an exposure unit including an exposure member; and an intermediate transfer unit including an intermediate transfer roller. When these units are mounted on a main body of the apparatus separately, the apparatus has to have a space between the developing unit, the intermediate transfer unit and the photoreceptor drum so as to avoid flaws on the photoreceptor drum. This may degrade relative positional precision between these units and so degrade the quality of images due to color registration error.

Then, an image forming apparatus is known, which includes a unit assembly including a plurality of processing units that are attached to a tray for jointing (for example, see Patent Literature 1). Such a conventional image forming apparatus including a unit assembly is configured so that the plurality of processing units as a unit assembly is integrally inserted/removed with respect to the main body of the apparatus. The intermediate transfer unit of this apparatus is fixed to the main body of the apparatus.

CITATION LIST

Patent Literature

Patent Literature 1: Japanese Unexamined Patent Application Publication No. H09-304994

SUMMARY OF INVENTION

Technical Problem

The conventional image forming apparatus including a unit assembly as stated above, however, does not provide any consideration for positioning between the processing units and the intermediate transfer unit. That is, positional precision between the processing units and the intermediate transfer unit may be degraded in this apparatus.

In electric transfer type image forming apparatuses, a plurality of developer images formed using a plurality of processing units are overlapped at the intermediate transfer unit to be one image, which is then transferred to a sheet. That is, poor positional precision between the plurality of processing units and the intermediate transfer unit causes misalignment among the images, and a color registration error in the case of a full-color image forming apparatus, and so the image quality deteriorates.

Then the present invention aims to provide a unit assembly capable of improving positional precision between a plurality of first processing units and improving positional precision between the plurality of first processing units and an intermediate transfer unit as well, and to provide an image forming apparatus including the same.

Solution to Problem

A unit assembly of the present invention is configured insertably/removably with respect to an apparatus main body of an image forming apparatus to perform electrophotographic image forming processing. The unit assembly includes: an image forming unit and an intermediate transfer unit. The image forming unit includes a plurality of first processing units each including a first image forming member of a plurality of image forming members to form a developer image, and a joint member that joints the plurality of first processing units so as to keep mutually relative positioning of the plurality of first processing units. The intermediate transfer unit bears the developer images formed using the plurality of first processing units and transfer the developer images to a transfer position to a sheet. The intermediate transfer unit is held by the image forming unit. The intermediate transfer unit and the joint member have a first positioning section for mutually relative positioning.

In this configuration, the plurality of first processing units are jointed for fixing to be integrated as the image forming unit, and then the image forming unit holds the intermediate transfer unit, whereby the unit assembly is configured. The plurality of first processing units and the intermediate transfer unit are integrated outside of the apparatus main body, which is then inserted/removed as the unit assembly with respect to the apparatus main body. In this way, there is no need of providing a space to prevent flaws during the assembly process of the first processing units and the intermediate transfer unit, and relative positional precision between the units in the apparatus main body can be improved as compared with the case where the units are individually inserted/removed. Further the plurality of first processing units that are mutually positioned are jointed with the joint members, and the intermediate transfer unit is positioned with reference to the joint members, whereby positional precision between the intermediate transfer unit and the plurality of first processing units can be more improved. Further this can make the apparatus compact because of its space-saving configuration.

An image forming apparatus of the present invention includes: a unit assembly, and an apparatus main body, with respect to which the unit assembly is inserted for fitting insertably/removably. Such an image forming apparatus can improve the positional precision between the plurality of first processing units as well as the positional precision between the plurality of first processing units and the intermediate transfer unit also, and so this can suppress misalignment among the images transferred from the image forming unit to the intermediate transfer unit, and can improve the image quality.

Advantageous Effects of Invention

According to the present invention, positional precision between a plurality of first processing units can be improved, and positional precision between the plurality of first processing units and an intermediate transfer unit also can be improved.

DESCRIPTION OF EMBODIMENTS

The following describes an image forming apparatus 100 including a unit assembly 10 according to one embodiment of the present invention, with reference to the drawings.

Figure 1:
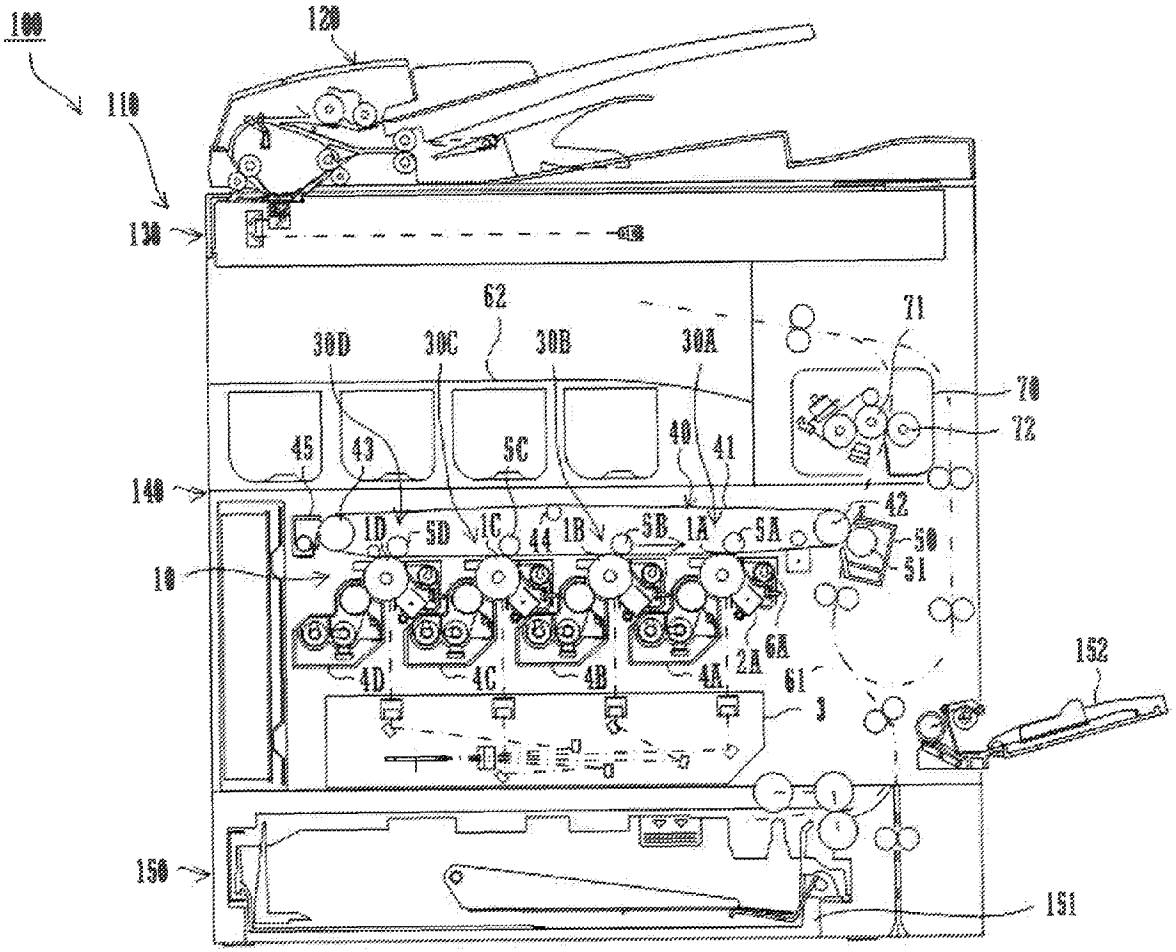
FIG. 1 is a frontal cross section schematically illustrating an image forming apparatus including a unit assembly according to Embodiment 1 of the present invention.

As illustrated in FIG. 1, the image forming apparatus 100 includes an apparatus main body 110 and an automatic document feeder (ADF) 120. The image forming apparatus 100 is configured to form a multicolored or single-colored image on a sheet in accordance with image data created based on a document or image data externally input. Exemplary sheets include ordinary paper, photographic paper, and a sheet-form recording medium such as an OHP film.

The ADF 120 is disposed above the apparatus main body 110.

The apparatus main body 110 includes an image reading section 130, an image forming section 140 and a sheet feeding section 150.

The image reading section 130 is disposed at an upper part of the apparatus main body 110. In the fixed document reading mode, this section reads an image of a document disposed fixedly to create image data, and in the conveyed document reading mode, it reads an image of a document being conveyed one by one by the ADF 120 to create image data.

The image forming section 140 includes a light scanning device 3, four image forming stations 30A, 30B, 30C and 30D, an intermediate transfer unit 40, a secondary transfer unit 50, and a fixing device 70, and performs electrophotographic image forming processing on a sheet.

The intermediate transfer unit 40 includes an intermediate transfer belt 41, a drive roller 42, an idle roller 43, a tension roller 44 and a primary transfer roller 5A. The intermediate transfer belt 41 defines a loop-like moving path that is stretched across the drive roller 42, the idle roller 43 and the tension roller 44.

The image forming stations 30A to 30D of the image forming section 140 form toner images (developer images) in four colors including black, and three subtractive primary colors including cyan, magenta, and yellow that are results of color separation of a color image. The image forming stations 30A to 30D are disposed in a row along the moving path of the intermediate transfer belt 41. The image forming stations 30B to 30D have a substantially similar configuration to that of the image forming station 30A.

The image forming station 30A for black includes a photoreceptor drum 1A, a charger 2A, a developing unit 4A and a cleaning unit 6A.

The photoreceptor drum 1A is rotated in a predetermined direction by a driving force transmitted. The charger 2A charges the peripheral face of the photoreceptor drum 1A at a predetermined potential.

The light scanning device 3 applies laser beams modulated in accordance with image data for colors of black, cyan, magenta and yellow to the photoreceptor drums 1A, 1B, 1C and 1D of the image forming stations 30A to 30D, respectively. Then electrostatic latent images based on the image data for the colors of black, cyan, magenta and yellow are formed on the peripheral faces of the photoreceptor drums 1A to 1D, respectively.

The developing unit 4A supplies black toner (developer) that is the color of the image forming station 30A to the peripheral face of the photoreceptor drum 1A to make the electrostatic latent image thereon visible as a toner image. Similarly, the developing units 4B, 4C and 4D of the image forming station 30B to 30D supply their respective-colored toner to the peripheral faces of the photoreceptor drums 1B to 1D.

The outer peripheral face of the intermediate transfer belt 41 is sequentially opposed to the peripheral faces of the photoreceptor drums 1A to 1D. The primary transfer roller 5A is disposed at a position opposed to the photoreceptor drum 1A across the intermediate transfer belt 41. The positions where the intermediate transfer belt 41 and the photoreceptor drums 1A to 1D are opposed mutually are primary transfer positions.

Primary transfer bias that is constant-voltage controlled is applied to the primary transfer roller 5A, the primary transfer bias having the reverse polarity (e.g., positive) of the toner charge polarity (e.g., negative). The same applies to the image forming stations 30B to 30D. This makes the toner images in the respective colors formed on the peripheral faces of the photoreceptor drums 1A to 1D to be overlapped on the outer peripheral face of the intermediate transfer belt 41 one by one for primary transfer, whereby a full-colored toner image is formed on the outer peripheral face of the intermediate transfer belt 41.

When image data of some colors among black, cyan, magenta and yellow only is input, then the photoreceptor drums of the four photoreceptor drums 1A to 1D corresponding to the colors of the image data input only form electrostatic latent images and toner images, and toner images in the corresponding some colors only are primary-transferred to the outer peripheral face of the intermediate transfer belt 41.

The cleaning unit 6A collects toner left on the peripheral face of the photoreceptor drum 1A after developing and primary transfer.

The toner images primary-transferred to the outer peripheral face of the intermediate transfer belt 41 at their respective primary-transfer positions are then conveyed through the rotation of the intermediate transfer belt 41 to a secondary transfer position where the intermediate transfer belt 41 and a secondary transfer roller 51 provided in a secondary transfer unit 50 are opposed.

The sheet feeding section 150 includes a sheet feeding cassette 151, a manual-feed tray 152, and a sheet conveyance path 61. A sheet is then supplied to the sheet conveyance path 61 from either of the sheet feeding cassette 151 and the manual-feed tray 152 selectively as needed.

The sheet conveyance path 61 leads to an output tray 62 from each of the sheet feeding cassette 151 and the manual-feed tray 152 via the secondary transfer position and the fixing device 70.

The secondary transfer roller 51 comes into contact with the drive roller 42 across the intermediate transfer belt 41 under predetermined nip pressure.

When a sheet supplied from the sheet feeding section 150 travels through the secondary transfer position, secondary transfer bias that is constant-voltage controlled is applied to the secondary transfer roller 51, the secondary transfer bias having the reverse polarity (e.g., positive) of the toner charge polarity (e.g., negative). This allows the toner images on the outer peripheral face of the intermediate transfer belt 41 to be secondary-transferred to the sheet.

Toner left on the intermediate transfer belt 41 after the transfer of the toner image to the sheet is then collected by a cleaning device for intermediate transfer belt 45.

The sheet having the toner image transferred thereon is guided to the fixing device 70. The fixing device 70 includes a heating roller 71 and a pressurizing roller 72, and applies heat and pressure to the sheet passing through between the heating roller 71 and the pressurizing roller 72 to fix the toner image on the sheet. The sheet having the toner image fixed thereon is then discharged to the output tray 62, whose toner-image fixed face is placed downward.

One type or a plurality of types of image forming members to form toner images are unitized as processing units. One or more types of processing units and the intermediate transfer unit 40 are then included in the unit assembly 10. The image forming members include the photoreceptor drums 1A to 1D, the charger 2A, a developing roller, the primary transfer roller 5A, the cleaning unit 6A and the like. The developing roller may be a developer bearing member.

Figure 2:
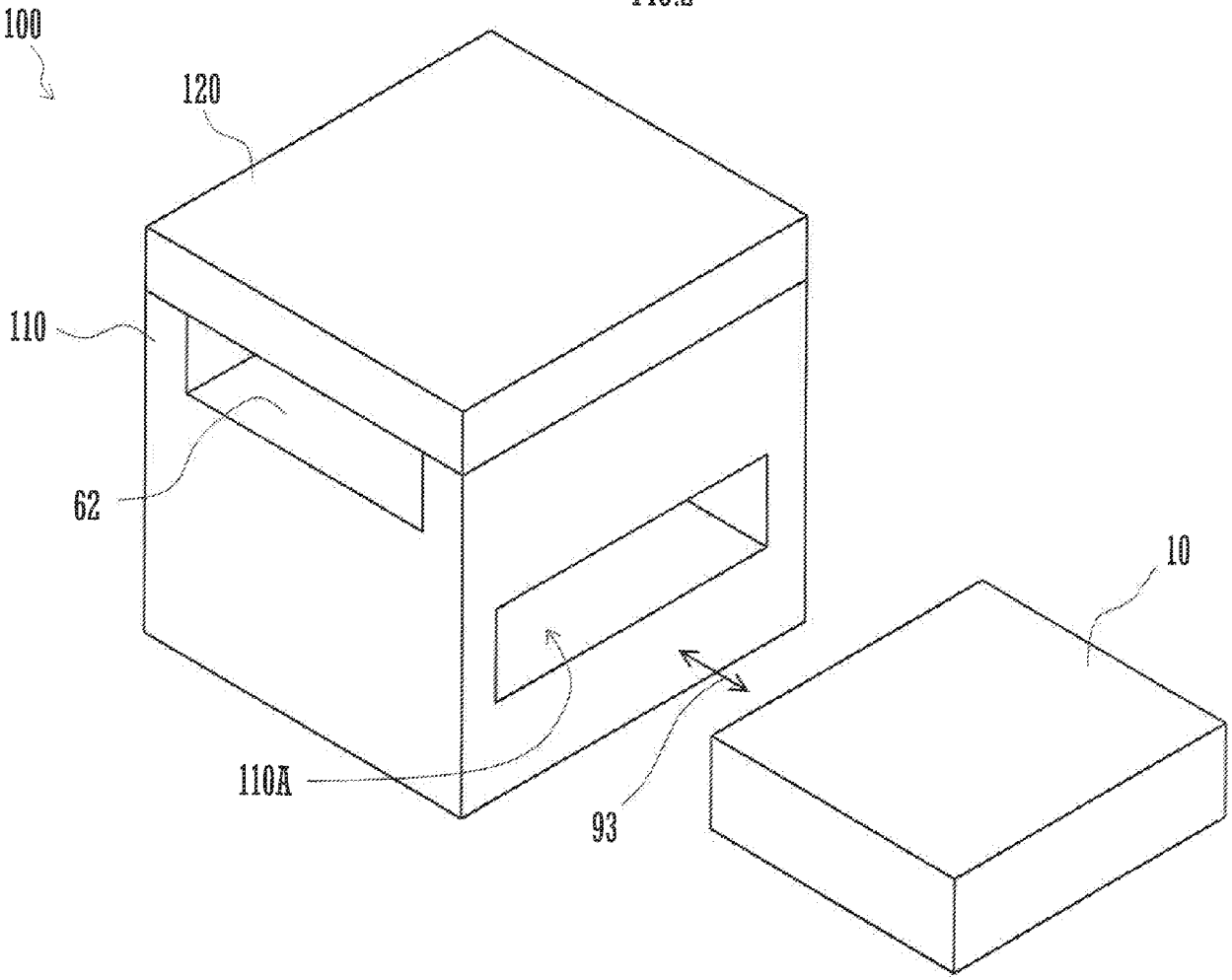
FIG. 2 is an external perspective view illustrating the state where the unit assembly is removed from the apparatus main body.
Figures 3A, 3B, 3C, 3D:
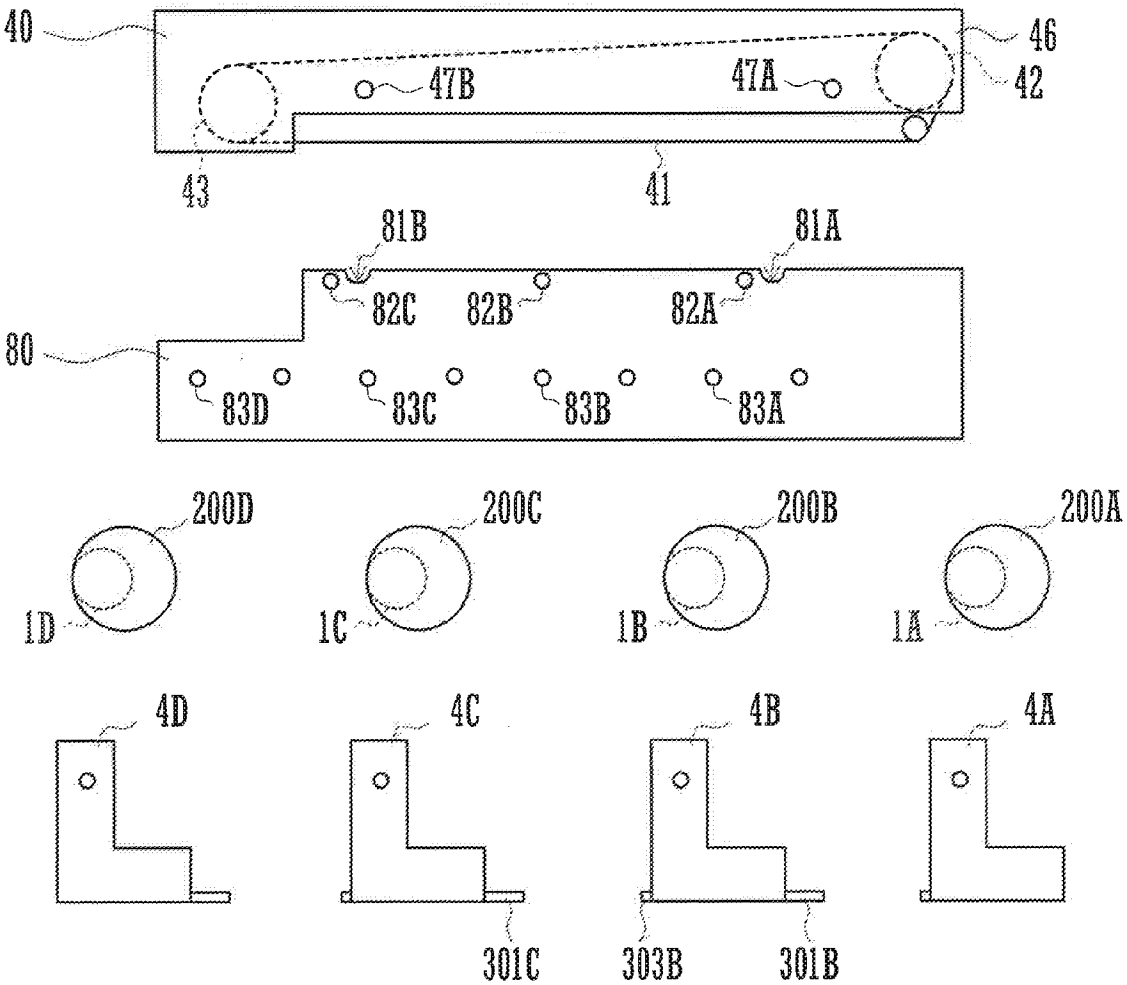
FIGS. 3A to 3D illustrate members included in the unit assembly.

As illustrated in FIG. 2, the apparatus main body 110 has an insertion section 110A that is open at the front face. The unit assembly 10 is configured insertably/removably with respect to the insertion section 110A of the apparatus main body 110 in a predetermined third direction 93 that is parallel to the rotary axis of the photoreceptor drum 1A. The third direction 93 is parallel to the insertion/removal direction of the unit assembly 10 with respect to the apparatus main body 110.

As illustrated in FIG. 3A to 3D, the unit assembly 10 according to the present embodiment includes the intermediate transfer unit 40, two joint members 80, a plurality of process units 200A, 200B, 200C and 200D and a plurality of developing units 4A, 4B, 4C and 4D. The process units 200A to 200D include the photoreceptor drums 1A to 1D, respectively, which correspond to a first processing unit. The developing units 4A to 4D include their developing roller, respectively, which correspond to a second processing unit. FIG. 3, FIGS. 7 to 9, FIG. 11 and FIG. 14 schematically illustrate the process units 200A to 200D and the developing units 4A to 4D.

The intermediate transfer unit 40 further includes a frame for intermediate transfer unit 46, where the drive roller 42 and the idle roller 43 are pivotally supported at the frame for intermediate transfer unit 46. The intermediate transfer unit 40 includes a plurality of protrusions 47A and 47B at predetermined positions of the frame for intermediate transfer unit 46 on the front face and the rear face. The plurality of protrusions 47A and 47B protrude horizontally, and are disposed at different positions in the traveling direction of the intermediate transfer belt 41.

Each joint member 80 has a plate form. Each of the joint members 80 has a plurality of concaves 81A and 81B at the positions corresponding to the plurality of protrusions 47A and 47B. Then each of the joint members 80 has a plurality of through-holes 82A, 82B, 82C, 83A, 83B, 83C and 83D.

Figure 4:
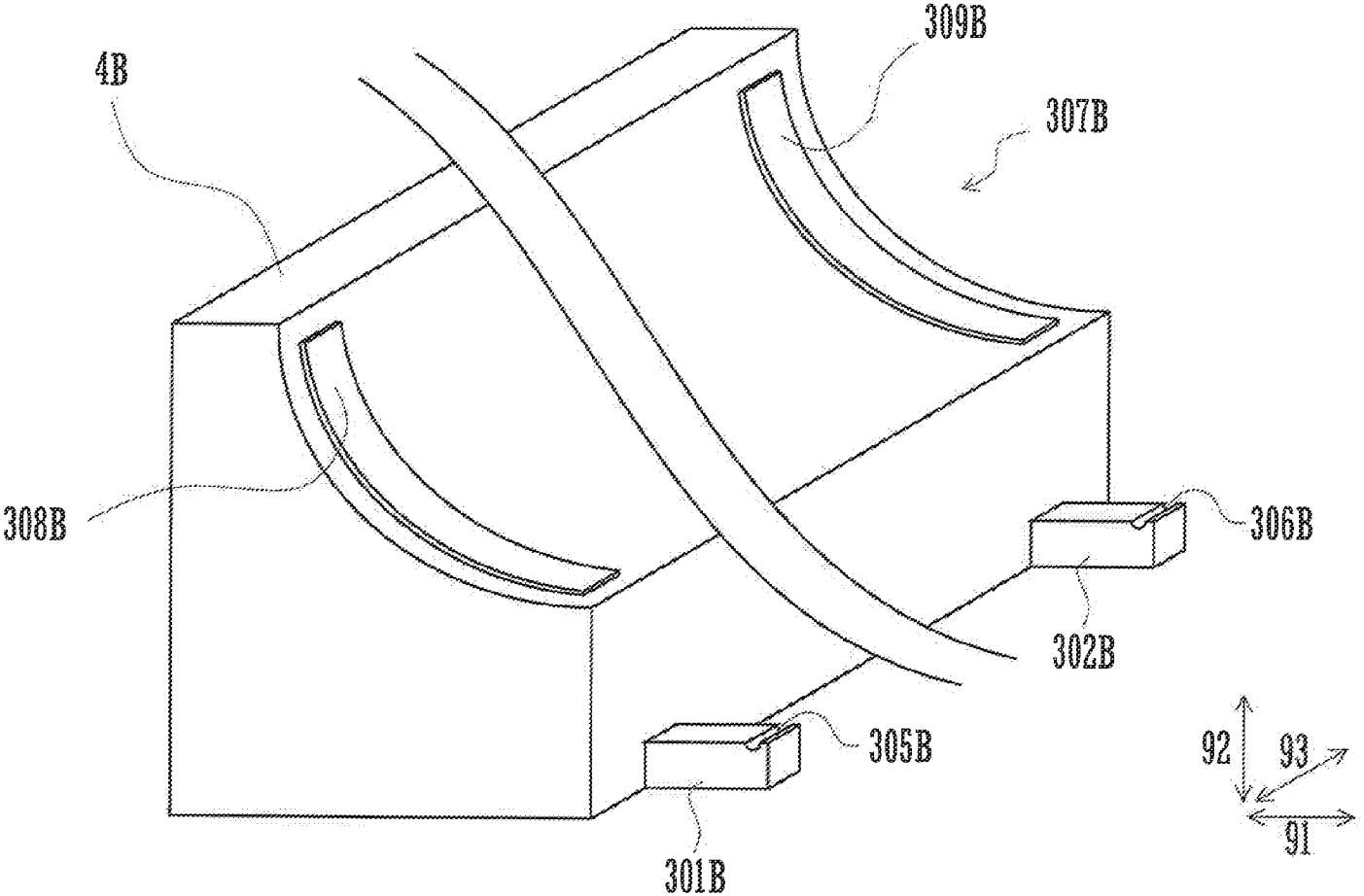
FIG. 4 is a perspective view from diagonally right of the developing unit, illustrating elongation sections included in the positioning section.
Figure 5:
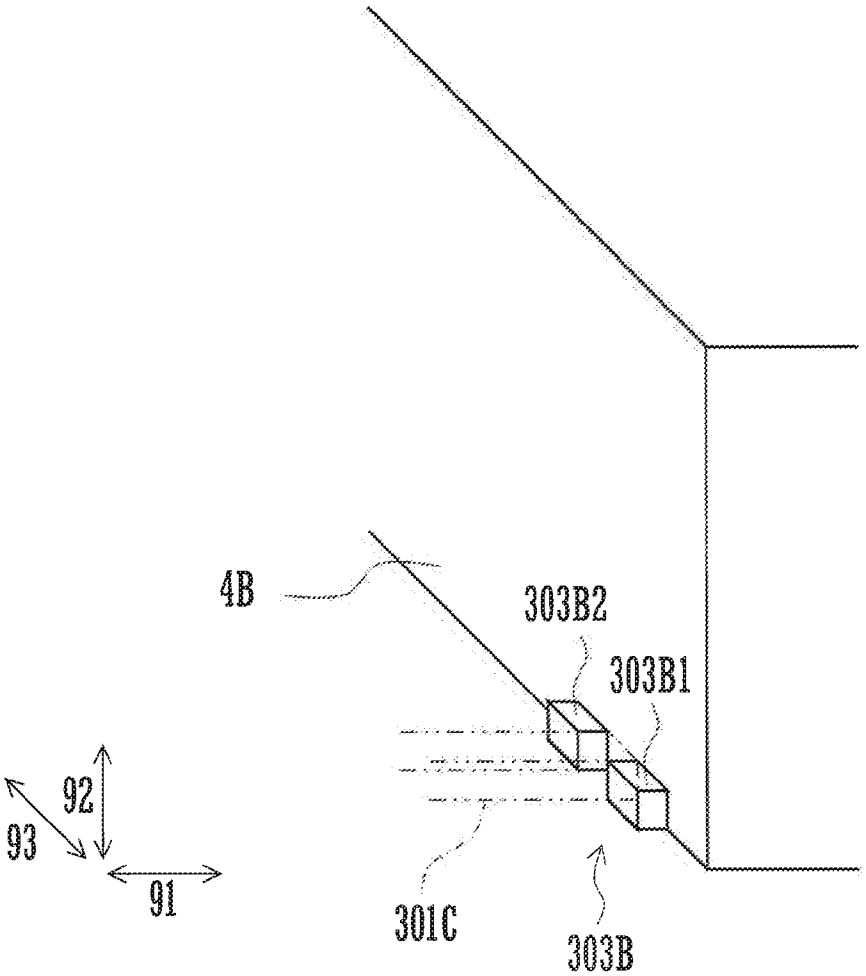
FIG. 5 is a perspective view from diagonally left of the developing unit, illustrating reception sections included in the positioning section.
Figure 6:
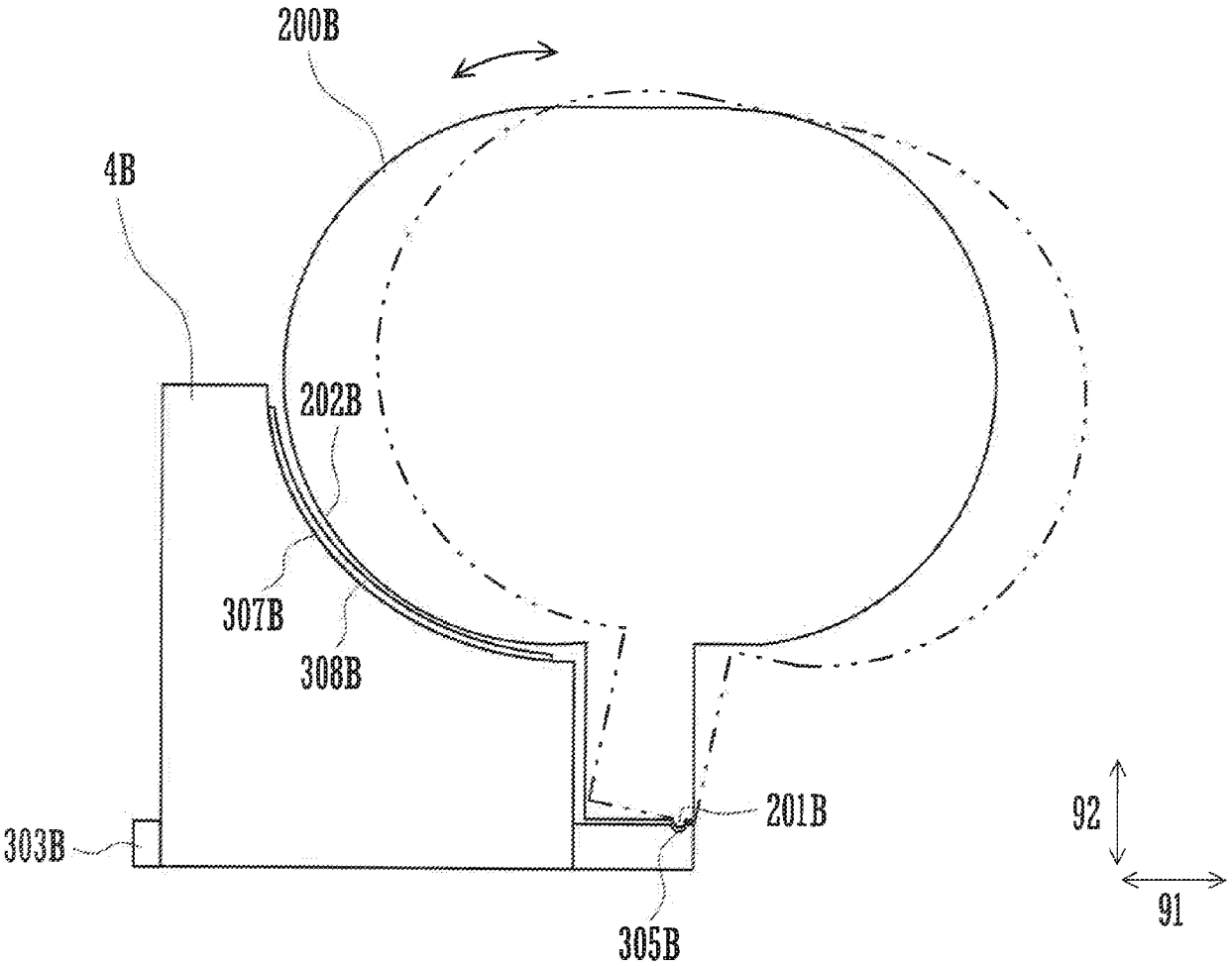
FIG. 6 is a front view of a process unit and a developing unit.

FIGS. 4 to 6 illustrate the configuration of the developing unit 4B that is disposed at a position other than both edges in the direction along which the developing units 4A to 4D are disposed. The developing unit 4C that is disposed at another position different from the developing unit 4B and other than both edges is configured similarly to the developing unit 4B. The developing unit 4A that is disposed at one end is configured similarly to the developing unit 4B except that it does not have an elongation section, and the developing unit 4D that is disposed at the other end is configured similarly to the developing unit 4B except that it does not have a reception section.

As illustrated in FIGS. 4 to 6, the developing unit 4B is preferably configured so that its barycentric position in a section orthogonal to the third direction 93 is located below from the center. In one example, the developing unit 4B is configured so that the dimensions in the horizontal direction increase toward the bottom in the section orthogonal to the third direction. In another example, the developing unit 4B may be configured so that the geometry of a section orthogonal to the third direction is a substantially triangle or a substantially trapezoid.

This can improve the stability of the developing unit 4B when the developing unit 4B is placed on a working table to let the developing unit 4B hold the process unit 200B, and so can improve the workability.

Let that mutually orthogonal three directions are called a first direction 91, a second direction 92 and the third direction 93. The first direction 91 is the same direction as the direction along which the developing units 4A to 4D are disposed. The second direction 92 is the direction orthogonal to a region of the intermediate transfer belt 41 that is opposed to an image forming unit 20 (see FIG. 8) described later. Then the third direction 93 is the insertion/removal direction of the unit assembly 10 with respect to the apparatus main body 110 as stated above.

The developing unit 4B has a third positioning section. The third positioning section includes elongation sections 301B, 302B and reception sections 303B and 304B (the reception section 304B is not illustrated). The elongation sections 301B, 302B are disposed at a first end part of the developing unit 4B in the first direction 91 and at both end parts of the developing unit 4B in the third direction 93. The reception sections 303B and 304B are disposed at a second end part of the developing unit 4B in the first direction 91 and at both end parts of the developing unit 4B in the third direction 93.

The elongation sections 301B, 302B of the developing unit 4B are elongated by a predetermined length from the first end part of the developing unit 4B toward the developing unit 4A adjacent to the first end part in the first direction 91.

The reception sections 303B and 304B are configured to receive elongation sections 301C and 302C, respectively, (the elongation section 302C is not illustrated) of the developing unit 4C adjacent to the second end part of the developing unit 4B.

The reception sections 303B and 304B are configured to limit the shift in the first direction 91 of the elongation sections 301C and 302C, respectively, of the developing unit 4C adjacent to the reception sections 303B and 304B.

The reception section 304B is configured similarly to the reception section 303B. In one example, the reception section 303B includes a first protrusion 303B1 and a second protrusion 303B2 that sandwich the elongation section 301C of the developing unit 4C adjacent to the reception sections 303B and 304B in the third direction 93.

The first protrusion 303B1 and the second protrusion 303B2 of the developing unit 4B sandwich the elongation section 301C of the developing unit 4C, so that the first protrusion 303B1 and the second protrusion 303B2 limit the shift of the elongation section 301C in both directions of the third direction 93. This can specify the position of the developing unit 4C with reference to the developing unit 4B in the third direction 93 precisely. In this way, when these plurality of developing units 4A to 4D are mutually relatively positioned, their positional precision in the third direction 93 between the plurality of developing units 4A to 4D can be improved.

The elongation section 301B has a bearing section 305B at a part in the vicinity of the front end to be extended in the third direction 93. The elongation section 302B has a bearing section 306B at a part in the vicinity of the front end to be extended in the third direction 93.

The process unit 200B has a shaft section 201B at a bottom thereof to be extended in the third direction 93. The shaft section 201B can be received rotatably by the bearing sections 305B and 306B.

The process unit 200B is configured so that, as its shaft section 201B is rotated while being supported at the bearing sections 305B and 306B, a predetermined first abutting section 202B becomes away from the shaft section 201B until the first abutting section abuts a predetermined second abutting section 307B of the developing unit 4B. The second abutting section 307B has a shape fitting to the outer shape of the first abutting section 202B.

The shaft section 201B of the process unit 200B is placed in the bearing sections 305B and 306B of the developing unit 4B for supporting while keeping a space between the first abutting section 202B of the process unit 200B and the second abutting section 307B of the developing unit 4B, and from this state, the process unit 200B is rotated around the shaft section 201B. This can achieve positioning between the process unit 200B and the developing unit 4B with two regions including the contact region between the shaft section 201B and the bearing sections 305B and 306B, and the contact region between the first abutting section 202B and the second abutting section 307B, and can suppress flaws occurring during the assembly process of the process unit 200B and the developing unit 4B.

Since the bearing sections 305B and 306B are provided at the elongation sections 301B and 302B, the distance between the shaft section 201B and the first abutting section 202B and the distance between the bearing sections 305B and 306B and the second abutting section 307B can be kept long, whereby positional precision between the process unit 200B and the developing unit 4B can be improved.

The developing unit 4B has buffer members 308B and 309B on the second abutting section 307B. This can further suppress flaws on the process unit 200B and the developing unit 4B.

Figure 7:
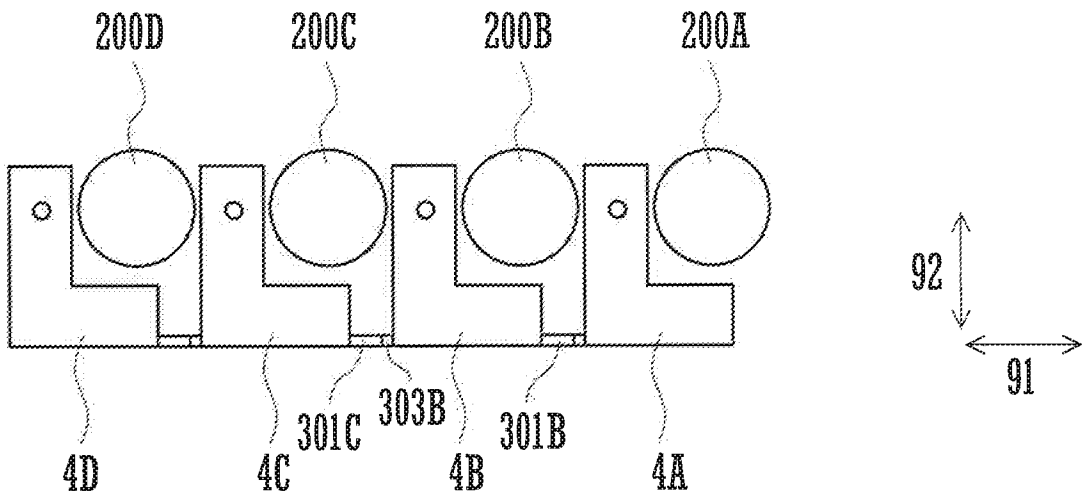
FIG. 7 is a front view illustrating the state where a plurality of process units are held by a plurality of developing units, respectively, and the plurality of developing units are mutually relatively positioned.

The process units 200A to 200D are held by the developing units 4A to 4D in this way, and the developing units 4A to 4D can be mutually relatively positioned, whereby positioning between the plurality of process units 200A to 200D and the plurality of developing units 4A to 4D can be performed precisely as illustrated in FIG. 7. Either of the process of letting the developing units 4A to 4D hold the process units 200A to 200D and the process of performing mutually relative positioning of the developing units 4A to 4D may be performed first.

Figure 8:
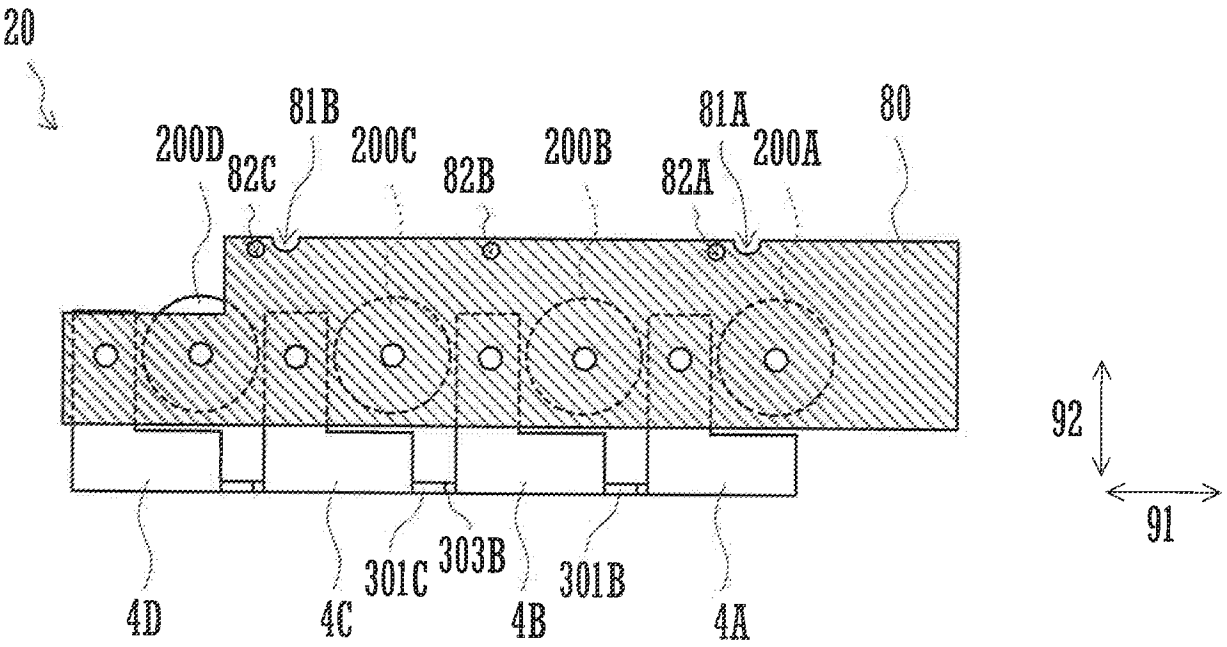
FIG. 8 is a front view of an image forming unit.

As illustrated in FIG. 8, the plurality of process units 200A to 200D are held at the plurality of developing units 4A to 4D, respectively, and the plurality of developing units 4A to 4D are mutually relatively positioned, and then the plurality of developing units 4A to 4D are mutually jointed with the joint members 80. FIG. 8 illustrates the joint member 80 in a hatch pattern for the purpose of illustration.

The joint members 80 are disposed on the front-face side and on the rear-face side so as to be opposed mutually while sandwiching the plurality of process units 200A to 200D and the plurality of developing units 4A to 4D therebetween.

The joint members 80 are fastened with screws through the through-holes 83A to 83D disposed at the positions corresponding to screw holes provided at the plurality of developing units 4A to 4D, respectively, to the screw holes of the plurality of developing units 4A to 4D. This can fix the mutually relative position between the plurality of developing units 4A to 4D with the joint members 80.

The through-holes 82A to 82C and 83A to 83D of the joint members 80 preferably are slots. The through-holes 82A to 82C and 83A to 83D in the form of slots that are elongated in the first direction 91 or the second direction 92 enables fine adjustment of the mutually relative position between the plurality of developing units 4A to 4D.

The process units 200A to 200D are born with shafts by the joint member 80 on the front-face side. The configuration between the joint member 80 on the rear-face side and the process units 200A to 200D is described later.

As stated above, the plurality of developing units 4A to 4D holding the plurality of process units 200A to 200D are jointed for fixing, whereby the image forming unit 20 is configured.

Figure 9:
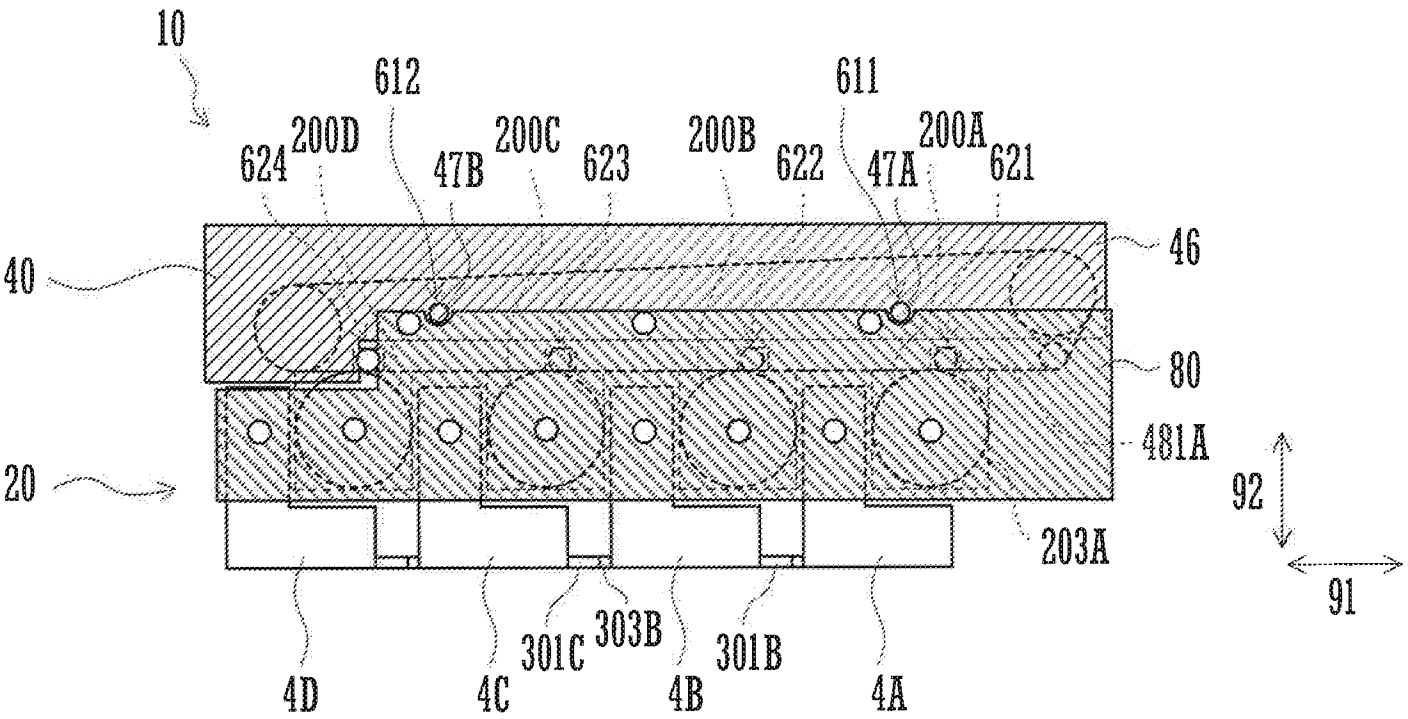
FIG. 9 is a front view of a unit assembly.

As illustrated in FIG. 9, the intermediate transfer unit 40 is held at the image forming unit 20, whereby the unit assembly 10 is configured. FIG. 9 illustrates the joint members 80 and the frame for intermediate transfer unit 46 in a hatch pattern for the purpose of illustration.

When the intermediate transfer unit 40 is assembled to the joint members 80 from the above, then the protrusion 47A and the concave 81A are fitted and the protrusion 47B and the concave 81B are fitted on both of the front-face side and the rear-face side, whereby the intermediate transfer unit 40 can be positioned precisely with reference to the joint members 80. The protrusion 47A and concave 81A and the protrusion 47B and concave 81B make up first positioning sections 611 and 612, respectively, for mutually relative positioning between the intermediate transfer unit 40 and the joint members 80.

In the state where the intermediate transfer unit 40 is positioned precisely to the joint members 80 on each of the front-face side and the rear-face side, then screws are fastened to screw holes of the intermediate transfer unit 40 via the through-holes 82A to 82C of the joint members 80. This can fix the intermediate transfer unit 40 in the state of being positioned precisely to the joint members 80 on the front-face side and the rear-face side.

Since the intermediate transfer unit 40 is fixed to each of the joint members 80 that are opposed mutually while sandwiching the plurality of process units 200A to 200D and the plurality of developing units 4A to 4D therebetween, the joint members 80 and the intermediate transfer unit 40 are fixed in the state of being disposed like a U-letter shape in a section so as to surround the three faces of the plurality of process units 200A to 200D and the plurality of developing units 4A to 4D. This means that the intermediate transfer unit 40 can function as a reinforcing member of the image forming unit 20.

Since the intermediate transfer unit 40 is disposed on the joint members 80, the unit assembly 10 can be assembled more easily.

Figure 10:
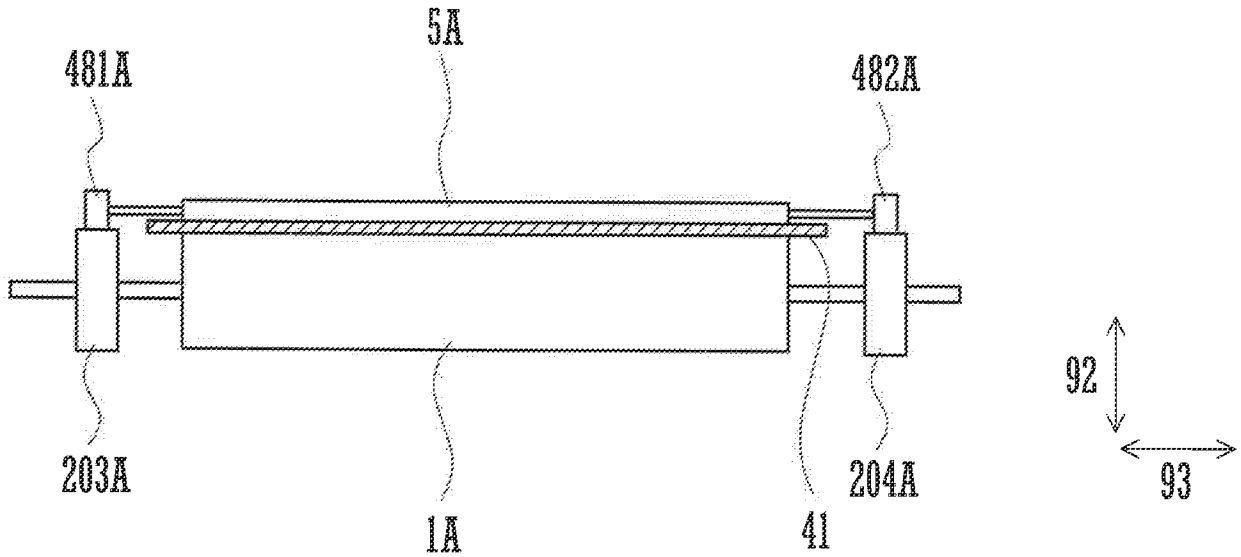
FIG. 10 illustrates the schematic configuration of a second positioning section.

FIG. 10 schematically illustrates the primary transfer roller 5A and the photoreceptor drum 1A from their right sight faces. As illustrated in FIG. 10, the intermediate transfer unit 40 has third abutting sections 481A and 482A on the front-face side and the rear-face side of the primary transfer roller 5A. Then the process unit 200A has fourth abutting sections 203A and 204A on the front-face side and the rear-face side of the photoreceptor drum 1A. When the intermediate transfer unit 40 is assembled to the joint members 80 from the above, the third abutting section 481A and the fourth abutting section 203A come into contact, and the third abutting section 482A and the fourth abutting section 204A come into contact, whereby the primary transfer roller 5A and the photoreceptor drum 1A that are mutually opposed are positioned, whereby mutually relative positional precision between the primary transfer roller 5A and the photoreceptor drum 1A can be more improved. The third abutting sections 481A and 482A and the fourth abutting sections 203A and 204A make up a second positioning section 621.

The intermediate transfer unit 40 has such third abutting sections as in the primary transfer roller 5A for the primary transfer rollers 5B to 5D as well. The process units 200B to 200D have such fourth abutting sections like the process unit 200A. Then, mutually relative positional precision between the primary transfer rollers 5B to 5C and the photoreceptor drums 1B to 1D that are mutually opposed can be more improved. These third abutting sections and fourth abutting sections mutually abutting make up second positioning sections 622, 623, and 624.

In the jointing direction of the plurality of process units 200A to 200D, i.e., in the first direction 91, the first positioning sections 611 and 612 are disposed between the second positioning sections 621 to 624. Specifically, in the first direction 91, the first positioning section 611 is disposed between the second positioning section 621 and the second positioning section 622, and the first positioning section 612 is disposed between the second positioning section 623 and the second positioning section 624.

This allows the first positioning sections 611 and 612 and the second positioning sections 621 to 624 to be scattered for disposition, and so the relative positional precision between the intermediate transfer unit 40 and the joint members 80 and the mutually relative positional precision between the primary transfer rollers 5A to 5D and the photoreceptor drums 1A to 1D mutually opposed can be more improved.

In the unit assembly 10, the plurality of process units 200A to 200D are held by the plurality of developing units 4A to 4D, the plurality of developing units 4A to 4D are jointed for fixing to be integrated as the image forming unit 20, and then the image forming unit 20 holds the intermediate transfer unit 40, and in this way, the unit assembly 10 is configured.

The plurality of process units 200A to 200D, the plurality of developing units 4A to 4D, and the intermediate transfer unit 40 are integrated outside of the apparatus main body 110, which is then inserted/removed as the unit assembly 10 with respect to the apparatus main body 110. In this way, there is no need of providing a space to prevent flaws during the assembly process of the units 200A to 200D, 4A to 4D, and 40, and relative positional precision between the units 200A to 200D, 4A to 4D, and 40 in the apparatus main body 110 can be improved as compared with the case where the units 200A to 200D, 4A to 4D, and 40 are individually inserted/removed. Further this can make the apparatus compact because of its space-saving configuration.

Since the unit assembly 10 is configured outside of the apparatus main body 110 so as to include the intermediate transfer unit 40 held by the image forming unit 20, and then the unit assembly 10 in such a state is inserted/removed with respect to the apparatus main body 110, positional precision between the image forming unit 20 and the intermediate transfer unit 40 also can be improved. This can suppress misalignment among the images transferred from the image forming unit 20 to the intermediate transfer unit 40, and so can improve the image quality.

The integration as the unit assembly 10 of the image forming unit 20 and the intermediate transfer unit 40 further can facilitate the handling, and so can lead to good operability of working such as replacement, maintenance and adjusting, and improve the working efficiency. This can suppress an error to place a wrong unit as well during insertion for fitting to the apparatus main body 110. That is, the workability of a user also can be improved. Since the positioning between the plurality of units 200A to 200D, 4A to 4D and 40 is performed outside of the apparatus main body 110, it can be performed easily and precisely as compared with the case of positioning performed inside of the apparatus main body 110, and so the workability of the assembling process of the image forming apparatus 100 can be improved.

Figure 11:
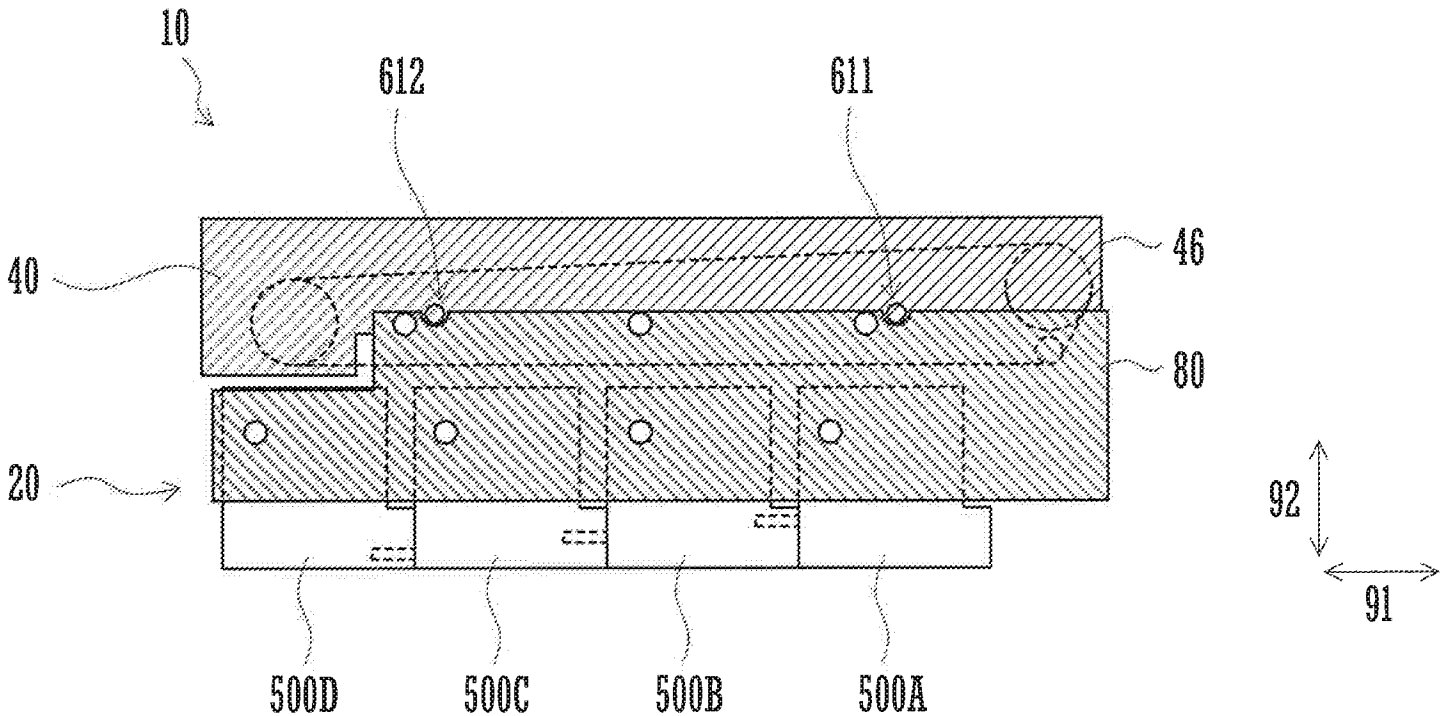
FIG. 11 is a front view of a unit assembly according to Embodiment 2.

As illustrated in FIG. 11, the unit assembly 10 according to Embodiment 2 may be configured so that the image forming unit 20 includes one type of processing units 500A to 500D, the third positioning section and the joint members 80. In this way, the types of the processing units included in the image forming unit 20 are not especially limited, and one, two or three or more types of processing units can be included. This can lead to the advantageous effect of improving the positional precision between the plurality of processing units and improving the positional precision between the image forming unit 20 including the plurality of processing units and the intermediate transfer unit 40 as well.

Other units to form toner images may be used as the first processing unit, instead of the process units 200A to 200D. In such a case as well, the positional precision between the plurality of first processing units can be improved, and the positional precision between the plurality of first processing units and the intermediate transfer unit 40 can be improved as well.

Figure 12:
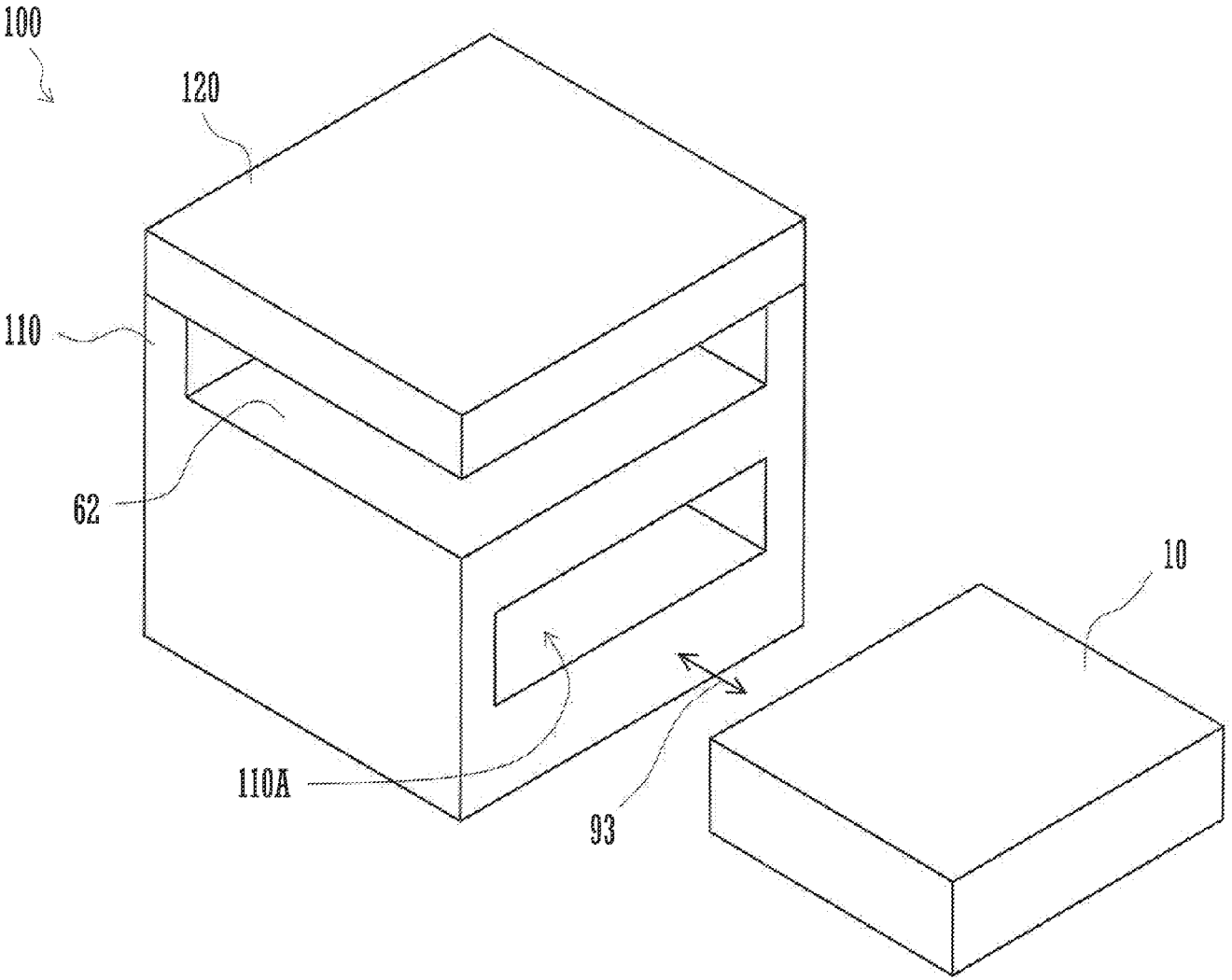
FIG. 12 is an external perspective view illustrating the state where a unit assembly is removed from the apparatus main body according to another configuration example.

The present invention is not limited to the use with the image forming apparatus 100 including the apparatus main body 110, in which the insertion section 110A and the output tray 62 are open at different faces of the apparatus main body 110. In the image forming apparatus 100 according to another configuration example, the insertion section 110A and the output tray 62 may be open at the same face of the apparatus main body 110. For instance, the insertion section 110A and the output tray 62 may be open at the front face of the apparatus main body 110, or may be open at one of the left and right side faces. Alternatively as illustrated in FIG. 12, the output tray 62 may be open at a plurality of faces including both of the same face as the insertion section 110A and another face. For instance, the output tray 62 may be open at the front face of the apparatus main body 110 and one of the left and right side faces. The configuration of the insertion section 110A and the output tray 62 that are open at the same face of the apparatus main body 110 can improve the operability and the workability of the user.

The above described embodiments are to be considered in all respects as illustrative and not restrictive. The scope of the invention is indicated by the appended claims rather than by the foregoing description. All changes which come within the meaning and range of equivalency of the claims are intended to be embraced therein.

REFERENCE SIGNS LIST

1A to 1D Photoreceptor drum
4A to 4D Developing unit (second processing unit)
5A to 5D Primary transfer roller
10 Unit assembly
20 Image forming unit
30A to 30D Image forming station
40 Intermediate transfer unit
80 Joint member
91 First direction
92 Second direction
93 Third direction (insertion/removal direction)
100 Image forming apparatus
110 Apparatus main body
110A Insertion section
200A to 200D Process unit (first processing unit)
201B Shaft section
202B First abutting section
301A, 301B, 302B, 301C Elongation members
303B Reception section
305B, 306B Bearing section
307B Second abutting section
308B, 309B Buffer member
611, 612 First positioning section
621 to 624 Second positioning sections

The invention claimed is:

1. A unit assembly that is configured insertably/removably with respect to an apparatus main body of an image forming apparatus to perform electrophotographic image forming processing, comprising:

an image forming unit including:

a plurality of first processing units each including a first image forming member of a plurality of image forming members to form a developer image;

a plurality of second processing units each including a second image forming member of the plurality of image forming members and each holding the plurality of first processing units; and a joint member that joints the plurality of second processing units so as to keep relative positioning of the plurality of second processing units; and an intermediate transfer unit that bears the developer images formed using the plurality of first processing units and transfers the developer images to a transfer position to a sheet, the intermediate transfer unit being held by the image forming unit, wherein the intermediate transfer unit and the joint member have a first positioning section for mutually relative positioning; and the second processing units are developing, units.

2. The unit assembly according to claim 1, wherein the intermediate transfer unit is disposed on the joint member.

3. The unit assembly according to claim 1, wherein a plurality of the joint members is disposed so as to be opposed mutually while sandwiching the plurality of first processing units therebetween, and the intermediate transfer unit is positioned with reference to the plurality of the joint members using the first positioning section, and then is fixed to the joint members.

4. An image forming apparatus, comprising:

the unit assembly according to claim 1; and an apparatus main body including an insertion section to which the unit assembly is inserted for fitting insertably/removably, the insertion section being open at a front face or either one of a right side face and a left side face of the apparatus main body.

5. The unit assembly according to claim 1, wherein the plurality of second processing units each include a second positioning section for mutually relative positioning of the plurality of the second processing units of the apparatus main body.

6. A unit assembly that is configured insertably/removably with respect to an apparatus main body of an image forming apparatus to perform electrophotographic image forming processing, comprising:

an image forming unit including:

a plurality of first processing units each including a first image forming member of a plurality of image forming members to form a developer image;

a plurality of second processing units each including a second image forming member of the plurality of image forming members and each holding the plurality of first processing units; and a joint member that joins the plurality of second processing units so as to keep relative positioning of the plurality of second processing units; and an intermediate transfer unit that bears the developer images formed using the plurality of first processing units and transfers the developer images to a transfer position to a sheet, the intermediate transfer unit being held by the image forming unit, wherein the intermediate transfer unit and the joint member include a first positioning section for mutually relative position;

the intermediate transfer unit includes a plurality of transfer rollers;

the first image forming members are photoreceptor drums; and the intermediate transfer unit and the plurality of first processing units have a plurality of second positioning sections for mutually relative positioning between the transfer rollers and the photoreceptor drums that are mutually opposed.

7. The unit assembly according to claim 6, wherein the first positioning section is disposed between the second positioning sections in the joint direction of the plurality of first processing units.

8. An image forming apparatus, comprising:

the unit assembly according to claim 6; and an apparatus main body including an insertion section to which the unit assembly is inserted for fitting insertably/removably, the insertion section being open at a front face or either one of a right side face and a left side face of the apparatus main body.

* * * * *